United States Patent [19]

Heaney

[11] 3,990,576

[45] Nov. 9, 1976

[54] TRANSPARENT CONTAINER FOR GLASS PANELS

[75] Inventor: James J. Heaney, Glendale, Calif.

[73] Assignee: Anthony's Manufacturing Company, Inc., San Fernando, Calif.

[22] Filed: Jan. 30, 1975

[21] Appl. No.: 545,370

[52] U.S. Cl. ..... 206/453; 206/454; 206/497; 206/521; 229/14 C

[51] Int. Cl.[2] ..... B65D 85/30; B65D 85/48

[58] Field of Search ..... 206/45.31, 45.33, 321, 206/325, 386, 442, 451, 453–454, 497, 521, 523, 525, 455–456; 211/29, 41, 50; 229/14 C

[56] References Cited

UNITED STATES PATENTS

| | | | |
|---|---|---|---|
| 2,681,733 | 6/1954 | Welshenbach et al. | 206/453 |
| 2,717,073 | 9/1955 | Young | 206/45.33 X |
| 2,776,745 | 1/1957 | Van Antwerpen | 206/453 |
| 2,792,936 | 5/1957 | Johnson | 206/451 |
| 3,111,724 | 11/1963 | Piekarski | 206/325 |
| 3,181,766 | 5/1965 | Kane et al. | 206/523 X |
| 3,225,919 | 12/1965 | Swingle | 206/386 |
| 3,390,765 | 7/1968 | Grant | 206/386 |
| 3,429,095 | 2/1969 | Huson | 206/386 X |
| 3,809,311 | 5/1974 | Fohrman et al. | 206/497 X |

OTHER PUBLICATIONS

T927,008, Oct. 1974, Sherman et al. 206/454.

*Primary Examiner*—Steven E. Lipman
*Attorney, Agent, or Firm*—Kleinberg, Morganstern, Scholnick & Mann

[57] ABSTRACT

A novel arrangement and associated method for packaging glass doors and the like for shipment and handling, one requiring less time and materials and involving exposing the "breakable-glass" character of the contents in full view to handling personnel, as a cautionary measure — this method, in one embodiment involving a wrapping of a bundle of glass doors in a packing strip to be spaced and cushioned around their edges; cinching of this bundle onto a pallet, and covering the palletized bundle with a transparent film, preferably by heat-shrinking a clear plastic envelope there-around.

12 Claims, 3 Drawing Figures

TRANSPARENT CONTAINER FOR GLASS PANELS

THE FIELD OF THE INVENTION

Figure 1:
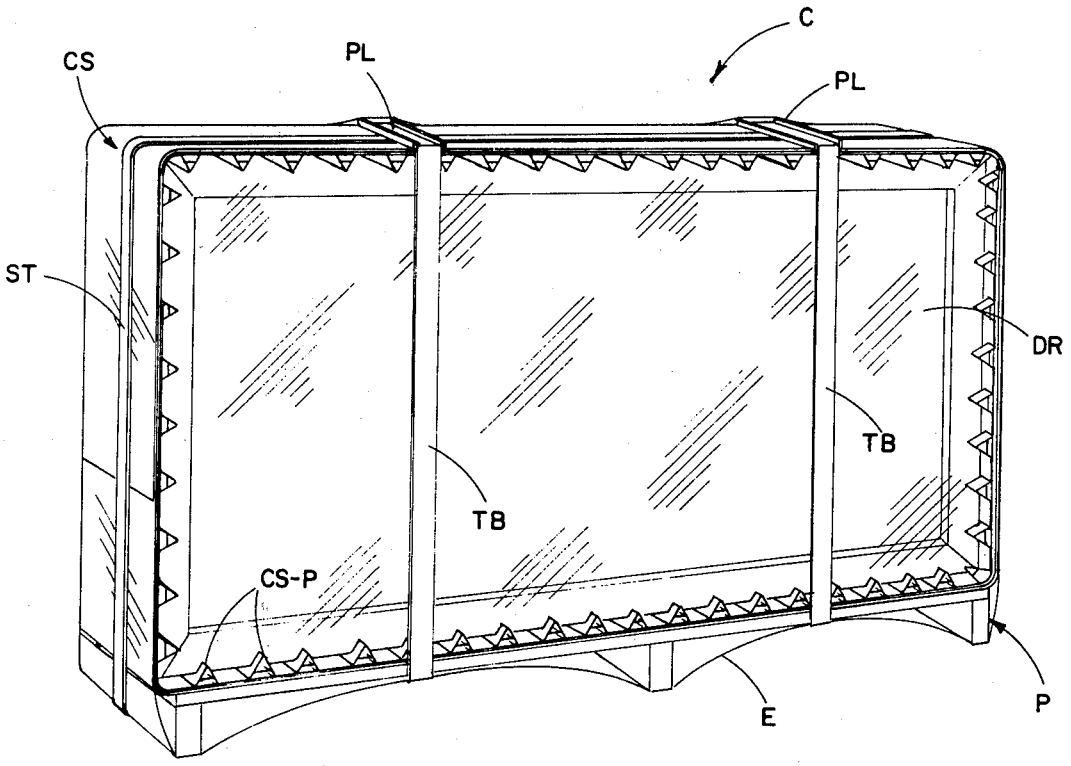

The subject invention relates to packaging arrangements and associated methods and, more particularly, relates to packing glass doors and the like for shipment so as to require a minimum of time and materials while also reducing mass, and especially so as to flag the fragile nature of the packaged contents.

BACKGROUND, PROBLEMS

Workers in the art of packaging fragile articles, such as glass refrigerator doors (e.g., as described in U.S. Pat. No. 3,612,821 to Stromquist) and the like for shipping and associated handling recognize a number of problems and inadequacies in the present state of the art. For instance, as described in U.S. Pat. No. 3,414,124 to Lidgard, shipping containers for such plate glass articles typically involve a six-sided crate (parallelepiped) of wood or similar material, with the plates stacked within, separated from the crate and from one another by a multiplicity of resilient spacer-cushions to provide some resistance to the shock and vibration of handling. However, such approaches have left something to be desired and workers are still in need of containers which are smaller, lighter, less expensive and less subject to breakage (as, indeed, is emphasized in Column 1 of the cited patent to Lidgard). The present invention is directed to such a container and associated methods.

Of course, workers are familar with certain methods and materials for packing articles for shipment. For instance, wrapping strips have been used to bind sets of doors together protectively (to be then inserted into a crate, or like outer structure) and corrugated padding has been used protectively around glass sheets. Also, fragile items, like glass sheets, have, of course, been packed for mounting on a pallet for easy handling; also straps or like binders have been used before for tying a shipping package together, such as onto a pallet (e.g., note U.S. Pat. Nos. 3,095,970; 3,231,084, 3,618,755; 3,273,706; 3,709,358; 3,645,389 and 3,547,457).

Presently, glass refrigerator doors stand in need of better packaging for shipment. For instance, such doors of the type adapted for refrigerated cabinets in retail food markets will typically weigh about sixty to seventy pounds, being about 6 feet or more in length by about 2 feet wide. They are typically shipped in rough wooden crates comprised of boards nailed (or glued) together, with about 4 to 5 or more doors packed therein, surrounded by resilient packing such as soft foam strips. The package formed by the doors so crated is rather fragile and subject to considerable glass breakage, as well as being relatively heavy and cumbersome. The excessive weight and bulk of such crates results in excessive shipping costs. The increasing cost of packaging materials and scarcity of wood presents further problems. Fabrication of the numerous parts of such packing containers requires excessive time and labor. Unpacking is also cumbersome and time-consuming. There is also a problem in disposing of the considerable packing debris.

Such crates are usually too bulky and difficult for one man to handle. For instance, a bulky crate containing four to five doors of the type mentioned, may weigh on the order of 400 to 500 pounds and stand over six feet tall. Now, if the crate topples flat from an upright position (as is all too likely), it obviously creates a risk of personal injury to handlers. It is also likely to break at least some of the glass contents. Such a toppling can readily occur while a crate is being loaded (e.g., with a fork lift) onto a truck or rail carrier, or unloaded from, of manipulated on, the carrier (e.g., for "tie-down"). Other damage commonly results from dropping a crate from a loading dock or from a pile in a warehouse storage facility. This invention dispenses with such crates and, being lighter and less bulky, is less likely to be dropped; also, being stronger, it is more likely to survive a drop with the glass intact.

Wooden crates cannot, of course, be handled manually without great difficulty. Not only are they heavy and bulky, but they easily splinter. Further, they often rupture when handled by fork lift equipment, as when they are dropped too rapidly.

Now, with such wooden crating materials consituting on the order of 100 to 125 pounds per crate (including packing), it will be apparent that saving any substantial portion of this mass can significantly reduce the cost of fabrication, package bulk and weight, shipping and disassembly costs. Such a weight reduction will also facilitate manual handling.

The present invention is directed to reducing the mass and bulk of such wooden containers with the above indicated savings and advantages. For instance, in the embodiment described below, it has been found possible to save on the order of 80% of the weight of packing materials. This may amount to 25% of the entire package weight. The present invention results in less breakage and superior handling strength. The preferred structures are simpler and less expensive, they involve fewer parts and less labor for fabrication and disassembly. The structures may encorporate more reliable, lightweight materials, such as plastics, thin strip steel and corrugated cardboard strips, in place of heavy wood structures and bulky foam padding.

The techniques of the invention also lend themselves to automatic, or semi-automatic, container production, involving less expense and lower breakage factors. Advantages in unpacking are also present. For instance, a mere slitting of a plastic envelope and a snipping of metal tape is required as compared to knocking-down a bulky crate with a crowbar, etc., and possibly damaging the glass contents in the process.

Another, less obvious, disadvantage with crated containers of the type mentioned involves "concealed breakage", i.e., glass breakage inside the crate that goes undetected until unpacking takes places. As workers well know, when glass items, such as doors, are shipped and handled, there is always a risk of breakage. All too often such breakage goes unobserved and/or unreported until well after receipt from the shippers.

For instance, glass refrigerator doors of the type mentioned, may be warehoused for a number of months until needed — this often in the final stages of constructing a store. The door containers are then withdrawn and unpacked, often at the work site. Workers will recognize the inconvenience that results when such doors are unpacked broken. When the crate is opened, it may become apparent, for the first time, that one or all of the doors has "cracked" glass. This may cause delays and inconvenience (re-ordering, shipping, etc.) — at a time when delay can least be afforded. In short, when a customer stockpiles crated glass articles, it is to his advantage to discover handling damage at an early stage. Present crating methods do not lend themselves to such early discovery. Structures in accordance with the present invention allow for immediate inspection and discovery of handling damage.

There is a further, and somewhat insidious, disadvantage associated with "concealed breakage"; it involves collecting compensation from a freight carrier or warehouseman. In general, it is considerably more difficult to collect for "in-crate" breakage when it is discovered after the fact, since then, the responsible carrier or warehouseman frequently takes the position that the breakage may have occurred "upstream" of his handling. This raises questions of "what happended, when and who caused it"; and complicates insurance claims. These problems are compounded by government (ICC) regulations and by the customs of the trade which limit collection in instances of "concealed breakage".

The present invention does away with such "concealed breakage" problems by, in effect, tearing-open the opaque covering about such containers and opening-up the frangible contents to full view. Thus, any breakage should be evident as soon as it occurs, and concealed breakage is avoided. Moreover, the invention has the further advantage of imposing a subtle, yet genuine and surprising, psychological restraint on those handling a container. The "look of glass" instills an unusually high degree of care. That is, it is found that those who normally ignore labels such as "Fragile", "Glass", "Handle with Care" are nonetheless rather sensitive to "visible glass". The appearance of breakable glass panels inspires caution. Experience has been that using "transparent" shipping containers in accordance with the present invention results in an astonishing drop in shipping and handling breakage.

SUMMARY OF THE INVENTION

In accordance with the present invention, an improved packaging arrangement for doors with glass panels, and the like, is disclosed which obviates the above deficiencies of the prior art.

As opposed to the time consuming procedures involved in constructing massive wooden crates and fitting the heavy doors therein with resilient pads clustered about each door, the present invention involves "racking-up" a set of doors, on end, and placing the doors on a corrugated cardboard strip. The strip prespaces and aligns the doors. The strip is bound around the doors. The bundle is cinched onto a pallet. A "shrinkable" preferably transparent envelope is dropped over the package, shrinking and sealing it.

This arrangement provides a structure capable of packing a number of doors using much less material and labor, yet more effectively producing a shipping package which has lower mass, is stronger and which prominently displays the fragile nature of the glass contents in full view of handling personnel. Such a package is not only lighter, dispensing with most of the common wood crating and related packing materials, but is less expensive and easier to assemble and disassemble.

Briefly described, a package of glass doors is provided which includes peripheral wrapping means adapted to quickly and easily encircle and bind a set of doors, in fixed parallel spaced alignment, encircling the doors about their edges, while leaving (at least a substantial portion of their) glass surfaces uncovered and exposed.

With this set, so wrapped, placed upon a simple pallet, cinching means are then provided to encircle the set, transverse to the wrapping direction and tie it down on the pallet. The cinching means may comprise a plurality of straps crossing the wrapped doors on respective bridging means (e.g., U-bars) to preserve the protected spaced relation of the doors despite cinching tension. Transparent cover means is preferably applied at least over the exposed glass surfaces to protect them.

Figure 1A:
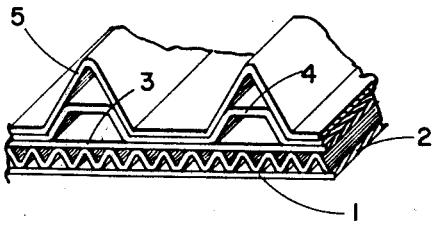
Figure 2:
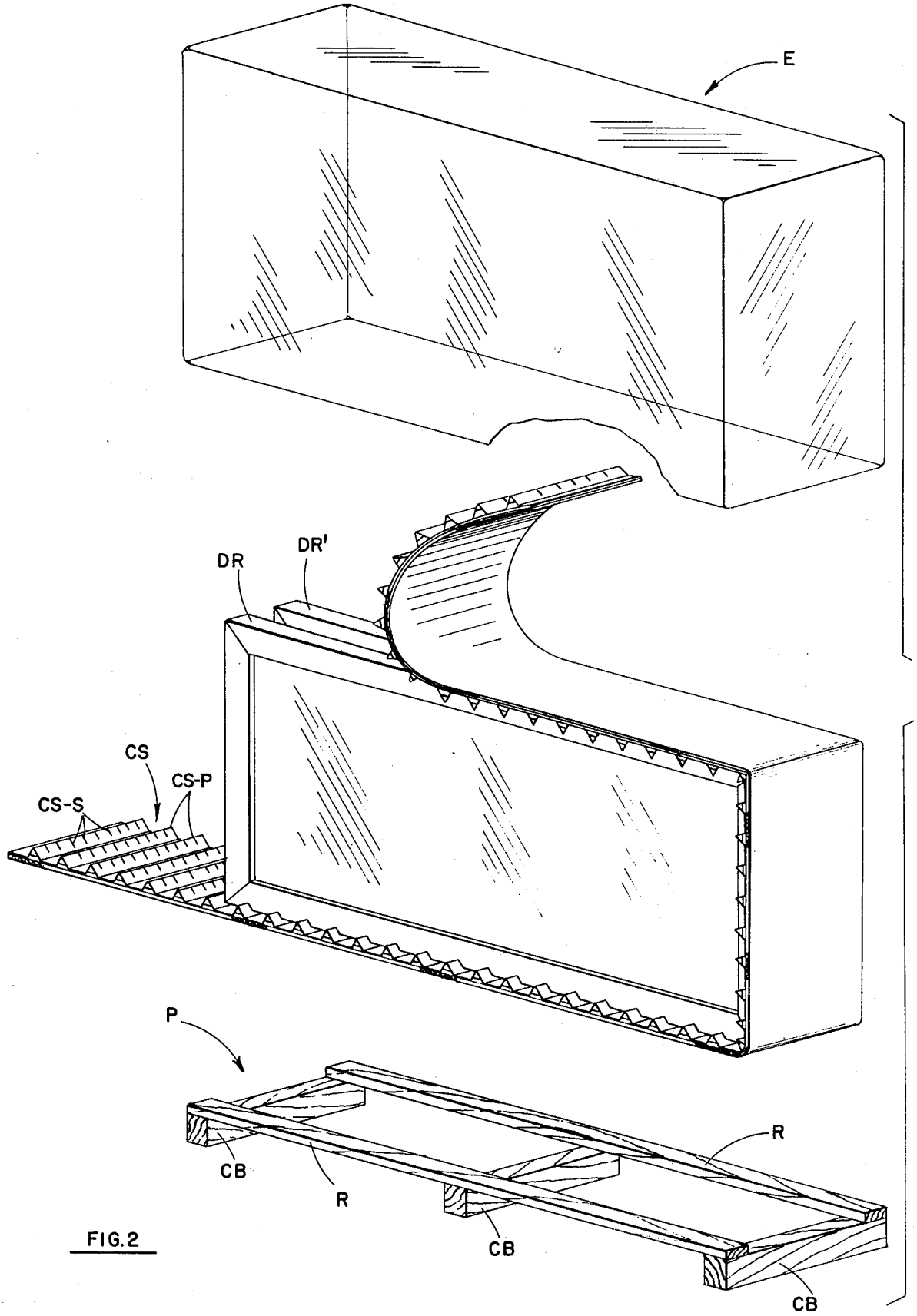

The invention and associated features of novelty and advantage will become apparent to those skilled in the art upon consideration of the following disclosure of preferred embodiments of the invention in conjunction with the accompanying drawings wherein like reference numerals denote like parts:

FIG. 1 discloses a preferred embodiment of the invention in side elevational perspective; and FIG. 1A shows, in cross-sectional enlarged view, a wrapping strip portion of the arrangement in FIG. 1; and FIG. 2 illustrates, as a "fabrication-assembly", with some members exploded-away and some omitted, the embodiment of FIG. 1 with the pallet member and envelope being exploded-away and the wrapping strip only partly wound, for clarity of illustration.

DETAILS - PREFERRED PACKAGE

One embodiment of the invention, shown in FIGS. 1 and 2, generally comprises a wrapped set of glass doors DR, DR′ mounted on a wooden pallet P, the doors being edge-wrapped by a corrugated cardboard strip CS, or like spacing-retainer means, bound about the edge periphery of the door-set mounted therein, being held there with one (or several) strap means ST. A pair of tension band means TB serves to bind the doors so-wrapped onto the pallet P and rigidfy the bundle laterally (normal to the elongate door-axes). A transparent protective cover or envelope E is provided over (at least) the exposed outer faces of the bundled doors.

More particularly, as shown in FIG. 2, a number of doors DR, DR′ (two shown here for convenience) are shown as mounted on pallet P, being positioned in perforated receiving-channel portions CS-S of a wrapping strip CS in a well-known manner, and held wrapped in strip CS by a tie ST as binding means (FIG. 1). The doors so wrapped into a bundle are placed upon a suitable pallet P and cinched tightly thereto.

Pallet P is preferably constructed to be quite simple and light, here comprising a few (preferably 3 or 4) parallel liners, or strips or wood or other structural material, nailed, stapled or otherwise joined to a pair of parallel rails R. Preferably, the packing indicated in FIG. 1 is constructed according to the method discussed below, and with the material mentioned.

METHOD STEPS, AND MATERIAL PARTICULARS

1. Wrapping Method

Wooden pallet P is, preferably, formed by nailing a number of wooden liner slats CB to rails R, spaced apart to receive the door bundle, thus forming a pallet for carrying the door bundle and allowing it to be handled with typical material handling equipment, such as a forklift truck. For the typical four-door bundle (doors each about 5×2 feet ×3 inches and 70 pounds), the wood rails R are fastened onto about three or four wooden skids CB, by nailing, stapling, etc. For instance, 2 inches ×1 inch oak rails on 1 inch ×1 inch oak skids are found quite suitable for handling bundles weighing up to about 370 pounds—about 350 pounds comprising the door-contents and only about 20 pounds comprising packing!

The elongate corrugated cardboard wrapping strip CS may be fastened, such as by nailing, to pallet P (both being of a width sufficient to span the contemplated number of doors, as spaced-apart for safety) and sufficiently long to encircle the stacked-door periphery, as shown in-process in FIG. 2. Strip CS preferably comprises a strip of "sus-wrap" material (trade name of Vanant Co., Div. Menansha Corp., Milwaukee, Wis.—see also U.S. Pat. No. 3,095,970 to Gaulke showing similar wrapping strip) or a like cardboard laminate or other spacing-cushioning strip known in the art. "Sus-wrap" CS is arranged and constructed as shown in FIG. 1A; that is, a corrugated cushion-layer 2 is bonded between a pair of flat cardboard strips 1, 3 on each side with the corrugations spaced and laminated therebetween to be maintained in proper, regular spaced relation. On the opposite side of substrate 3, there is laminate-bonded a differently-sized, bi-part corrugation with A-shaped spacer ridges comprising truncated-ridges from layer 4 and, atop that, similarly spaced A-shaped ridges from top layer 5, bonded to layer 4.

As shown in the perspective view of FIG. 2, the ridges of layers 4, 5, are cut, or perforated along a number of aligned split-pairs CS-S, each pair being cut thru both ridge members along a prescribed axis and spaced apart sufficient to accommodate a door-width; so that when a door is pushed forcibly onto the ridge-section between such a pair of perforations, it will collapse, receiving the door aligned between upstanding double-ridge sections — to thus be pre-positioned, and held so, when the strip CS is wrapped to encircle the doors. These slit pairs are spaced apart sufficient to maintain the contemplated doors positioned out of contact with one another. Thus, positioning ridges 4, 5 are cut across their width to form spaced crushable slots, or channels, sized to the approximate expected door thickness and spaced apart in a regular prescribed relation such as to allow for protruding handles and other door attachments. The ridge-interval is such as to adequately support the doors, presenting sufficient contact points for this. Of course, other means may be selected and adapted to accommodate such a binding of doors, while maintaining them in spaced relation, as will occur to those skilled in the art. For instance, a mere fouor "corner members" constructued, for example, like strips CS and suitably held in place at the four corners of the stacked door bundle may be used.

The strip CS may now be fastened to the pallet P. The prescribed number of doors (here four understood, only two being shown) are manually "spotted" thereon, each being forced into a prescribed channel formed by a respective pair of aligned spaced slits CS-S. The door stack may be held in position in the strip channels, while spacer strip CS-S is wrapped completely up both sides and across the top of the door stack, with respective top and side channels being similarly crushed-in to receive each door and the strip being held so wrapped until bound. Binding is preferably effected with a tautening binder, (metal strip ST), comprising a steel strip, pulled tight around strip CS and bound off. Strip ST serves to maintain the spacer strip CS in position, as well as to maintain the doors in spaced relation and in upright position as desired, being, preferable wound "between doors" to cinch-in strip CS tightly (with additional binders being optional).

2. Cinch onto Pallet

The so-wrapped bundle B is now mounted atop pallet P dimensioned in length and width to receive it and tied-down tightly, or cinched thereon with cinching means, such as a pair of bands TB (FIG. 1), looped under the pallet and over the bundle B with guide-bridging means (U-bars PL) being provided to span the top of the bundle as indicated in FIG. 1. Cinch bands TCA are constructed and applied to hold bundle B, while also ridigfying it. Bands TB are bound around the midsection of the package length, each between individual skids CB so as to be able to tighten down the door bundle securely, then being tied (eg., with a binding tool). A number of known tautening means may be used, such as a known tautening-binding tool for metal tape for improved package stability and strength. The preferred binders here, and for strip ST, comprise a steel band (eg., about ½ inch ×20 mil strip) cinched-up as known in the art; although other like binders, such as plastic coated fiberglass tape may be used instead in some cases.

Guide plates PL serve both to position and support a respective band TB, while preventing it from unduly digging into, and damaging, the spaced doors, or from squeezing them together across the top. Plate PL may comprise a rigid plate of metal, such as a steel U-bar, or like rigid material, preferably relieved centrally to receive its band TB as indicated and retain it in place, being sufficiently long to span the stack of doors and thus prevent any squeezing as mentioned. Two such bands TB have been found suitable for such a bundle and pallet, although more may be desired in certain cases.

With bands TB cinched-in place, bundle B is now secured onto the pallet P as a single integral container package and might in such instances be used in that form. However, preferably plastic sheeting is shrunk-fit over the package (at least the glass-exposing faces thereof) as described below.

3. Shrink-wrap Envelope

An envelope as best seen in FIG. 2 is now dropped over the so-wrapped and cinched bundle B and is secured thereto to expose the glass faces of the doors to view. The envelope is then gathered and sealed, preferably being heat-shrunk, around bundle B by means known in the art. Preferably envelope E comprises polyethylene, or like clear plastic, about 1 to 2 mils (or greater) thick which is heat-shrinkable and dimensioned to fit relatively snugly over bundle B on its pallet, being wrapped entirely therearound and heat-shrunk and sealed (thermally) to itself. This creates a relatively-tight, strong resilient, transparent panel over the glass-exposing faces of the bundle as indicated in FIG. 1, serving to protect the doors against intrusion of dirt, dust, moisture and the like, as well as from possible scratching or marring by passing objects. Of course, this film will not resist entry by a sharp piercing object; indeed it is destined to be slit-open and unwrapped in this manner. Another, clear, shrinkable film may be used instead, as understood by those skilled in the art and various heat-fusing and shrinking means, such as heat tunnel with infrared lamps of the like used to perform the shrinking.

Changes in the details may be made without departing from the spirit and scope of this invention as claimed.

What is claimed is:

1. A shipping package for stacking spaced, relatively planar breakable panels, or like articles, comprising: a continuous, elongate cushioning spacer strip encompassing the periphery of the panels, said strip including a cushioning means and positioning members disposed at spaced intervals along the strip and adapted to define a prescribed number of parallel spacing channels extending along the elongate axis of the strip, said strip being wrapped and secured about the edges of the panels stacked therewithin, each panel occupying a respective spacing channel, so as to leave substantial side portions of the breakable panels exposed to view; and a pallet strapped to said wrapped panel stack at a plurality of points with straps encircling the stack relatively transverse to the elongate axis of the strip, whereby the stack is so packaged as to nonetheless display the breakable character of planar panel surfaces.

2. The combination as recited in claim 1 wherein there is also included transparent protective film means disposed protectively over at least the exposed planar surfaces of said panel stack to thereby afford some protection against injurious contact to the breakable contents, while also leaving them displayed in full view.

3. The combination as recited in claim 1 wherein said panels comprise a palletized package of like glass structures stacked in a bundle in closely-packed, parallel side-by-side relation and on-edge, with their end surfaces being kept spaced and aligned by said strip; the panels, as wrapped in said strip, being cinched-down upon a wooden pallet, with said strips guided and bridged across the top of the stack on respective spacer bar members.

4. The combination recited in claim 3 wherein the strip comprises a laminated cardboard substrate with a resilient corrugated layer disposed on one side and a set of spaced, upstanding spacer members disposed on the opposite side thereof.

5. The combination recited in claim 4 wherein the panels comprise glass doors and wherein said strip is bound around the stack of doors with binding means secured thereabout so as to pull the strip up into the spacing between doors and thus hold them together in prescribed spaced alignment.

6. The combination as recited in claim 5 wherein the wrapped stack of doors is, in turn, enclosed in a transparent protective envelope.

7. The combination as recited in claim 6 wherein said spacer bar members each comprise an elongate metal U-bar of prescribed length, sufficient to span the width of the door stack across the door edges, each of said bars also including a U-channel provided therealong of a width sufficient to accommodate a respective cinch strap retained and aligned therein.

8. A packaging arrangement for handling frangible glass doors comprising an aligning strip material wrapped about the edge-periphery of said doors, said doors being stacked on-edge to form a bundle, said strip material being wrapped so as to leave a substantial portion of the door glass exposed to view; and substrate means provided under one edge of the bundle, so formed, the bundle and substrate means being attached by tie-down means, said tie-down means being arranged and deployed so as not to appreciably interfere with said glass exposure.

9. A palletized bundle of like frangible planar articles, such as glass doors or the like, comprising a set of said articles stacked in parallel, side-by-side, spaced alignment on a flat support means; said set being maintained in such alignment as a stack by resilient spacer-wrap means, said spacer-wrap means being wrapped about the edge periphery of said planar articles leaving planar frangible side surfaces of the stack exposed to view; said spacer-wrap means acting to wrap, resiliently cushion and space said articles, in alignment and maintain them so, being secured with binding means therearound; and tension strap means wrapped and secured about this stack so-wrapped transverse to the binding means for cinching the stack onto said support means.

10. The combination as recited in claim 9 wherein an envelope of clear plastic material is provided enclosingly about the stack, so-wrapped, to protect said side surfaces thereof.

11. The combination as recited in claim 10 wherein said tension strap means are each operatively associated with bridging means extending across the wrapped stack of articles; and wherein said spacer-wrap means comprises a multi-laminar strip including a layer of cushioning material and ridge-spacing means affixed on the strip so as to engage said articles; said ridge-spacing means being scored and folded to receive said articles in spaced apart prescribed relation.

12. The combination as recited in claim 11 wherein said articles comprise glass doors; wherein said strip comprises corrugated cardboard; and wherein said support means comprises a pallet.

* * * * *

UNITED STATES PATENT OFFICE

CERTIFICATE OF CORRECTION

Patent No. 3,990,576 Dated November 9, 1976

Inventor(s) James J. Heaney

It is certified that error appears in the above-identified patent and that said Letters Patent are hereby corrected as shown below:

Col. 6, lines 4, 8 and 11, after "bundle" delete "B"

Col. 6, line 11, before "are constructed" delete "TCA" and insert in lieu thereof -- TB --

Col. 6, line 36, after "bundle" delete "B"

Col. 6, lines 44, 47, 51, after "bundle" delete "B"

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*